US010077165B2

(12) United States Patent
Ahn

(10) Patent No.: US 10,077,165 B2
(45) Date of Patent: Sep. 18, 2018

(54) STAPLER APPARATUS

(71) Applicant: biztechone, Seoul (KR)

(72) Inventor: Woo Sup Ahn, Seoul (KR)

(73) Assignee: biztechone (KR)

( * ) Notice: Subject to any disclaimer, the term of this patent is extended or adjusted under 35 U.S.C. 154(b) by 0 days.

(21) Appl. No.: 15/397,015

(22) Filed: Jan. 3, 2017

(65) Prior Publication Data

US 2017/0233213 A1 Aug. 17, 2017

(30) Foreign Application Priority Data

Feb. 11, 2016 (KR) ..... 10 2016 0015664

(51) Int. Cl.

| | |
|---|---|
| ***B65H 37/04*** | (2006.01) |
| ***B31F 5/00*** | (2006.01) |
| ***B41L 43/12*** | (2006.01) |
| ***B42C 1/12*** | (2006.01) |
| ***B42B 4/00*** | (2006.01) |

(52) U.S. Cl.

CPC ..... *B65H 37/04* (2013.01); *B31F 5/001* (2013.01); *B41L 43/12* (2013.01); *B42B 4/00* (2013.01); *B42C 1/12* (2013.01); *B65H 2408/122* (2013.01); *B65H 2408/1222* (2013.01); *B65H 2801/27* (2013.01); *G03G 2215/00827* (2013.01); *G03G 2215/00848* (2013.01); *G03G 2215/00864* (2013.01)

(58) Field of Classification Search

CPC ..... B65H 37/04; B65H 2408/122; B65H 2408/1222; G03G 2215/00827; G03G 2215/00848; G03G 2215/00864; B42C 1/12; B31F 5/001; B41L 43/12

USPC ..... 270/37, 58.08, 58.09; 410/399

See application file for complete search history.

(56) References Cited

U.S. PATENT DOCUMENTS 5,911,414 A * 6/1999 Kato ..... B26F 1/10 234/38

6,164,511 A * 12/2000 Chung ..... B27F 7/006 227/111

(Continued)

FOREIGN PATENT DOCUMENTS

| | | |
|---|---|---|
| JP | 2013032208 | 2/2013 |
| KR | 1020120015626 | 2/2012 |

OTHER PUBLICATIONS

Corresponding Office Action issued by the KIPO dated Feb. 24, 2017.

*Primary Examiner* — Leslie August Nicholson, III

(74) *Attorney, Agent, or Firm* — The Belles Group, P.C.

(57) ABSTRACT

A stapler apparatus may be provided. More specifically, a stapler apparatus capable of automatically stapling a bundle of sheets output from an image forming apparatus such as a copy machine, a printer, a facsimile or the like may be provided. The stapler includes: a guide plate in which a slot having a branch structure has been formed; a moving frame which is reciprocatively movable on the guide plate; a rotation frame which is rotatable on the moving frame and includes a plurality of levers mounted thereon, the plurality of levers moving along the inside and outside of the slot or change paths; a path change member which changes a movement path of any one of the plurality of levers; and a stapler which is mounted on the rotation frame and is in conjunction with the rotation frame.

11 Claims, 6 Drawing Sheets

(56) References Cited

U.S. PATENT DOCUMENTS 6,427,997 B1 * 8/2002 Hirota ..... B42C 1/12
270/58.12
8,474,808 B2 * 7/2013 Matsuo ..... B65H 37/04
270/58.08
8,613,382 B2 * 12/2013 Jung ..... B27F 7/006
227/156

* cited by examiner

STAPLER APPARATUS

CROSS REFERENCE TO RELATED APPLICATIONS

Priority is claimed under 35 U.S.C. § 119 to Korean Patent Application No. 10-2016-0015664, filed Feb. 11, 2015, the entirety of which is incorporated herein by reference.

BACKGROUND

Field

This embodiment relates to a stapler apparatus and more particularly to a stapler apparatus capable of automatically stapling a bundle of sheets output from an image forming apparatus such as a copy machine, a printer, a facsimile or the like.

Description of the Related Art

In general, the structure of an image forming apparatus such as a copy machine, etc., includes a sheet post-processing device which post-processes a sheet discharged from the side of the image forming apparatus. The sheet post-processing device stacks sheets copied and discharged from the image forming apparatus in an upper tray, causes the sheet on which operations such as copying, etc., have been completed to be punched by using a punch, or staples the sheet by a stapler and then stacks the sheets in a lower tray. The structure of a stapler apparatus constituting the sheet post-processing device has been variously developing. For example, the stapler apparatus staples the cross section of the transferred sheet while moving in the form of a straight line, or staples a side edge of the sheet at a 45 degree angle.

Korean Patent Application Laid-Open Publication No. 10-2012-0015626 (hereafter, referred to as Patent Document 1) discloses a stapler apparatus enabling a stapler to softly move rotationally on both sides thereof.

The stapler apparatus of the Patent Document 1 staples a bundle of sheets arranged within the sheet post-processing device 2.

According to the stapler apparatus of the Patent Document 1, it is possible only to obliquely staple a corner of a bundle of sheets arranged within the sheet post-processing device 2. That is, the stapler apparatus of the Patent Document 1 cannot perform flat-stapling. In other words, the stapler apparatus of the Patent Document 1 cannot staple in parallel with one side of the sheet.

BRIEF SUMMARY

One embodiment is a stapler apparatus including: a guide plate in which a slot having a branch structure has been formed; a moving frame which is reciprocatively movable on the guide plate; a rotation frame which is rotatable on the moving frame and includes a plurality of levers mounted thereon, the plurality of levers moving along the inside and outside of the slot or change paths; a path change member which changes a movement path of any one of the plurality of levers; and a stapler which is mounted on the rotation frame and is in conjunction with the rotation frame.

The slot may include a reference slot and the plurality of branch slots which branch from one end of the reference slot. The plurality of levers may include a moving lever moving within the slot and include a path change lever moving outside the slot. The path change member may change a movement path of the path change lever and causes the moving lever to enter, from the reference slot, into any one of the plurality of branch slots which extends in a direction different from an extension direction of the reference slot.

When the path change member does not change the movement path of the path change lever, the moving lever may enter, from the reference slot, into one of the plurality of branch slots which extends in a direction the same as an extension direction of the reference slot.

The slot may include a reference slot, a first branch slot which branches from one end of the reference slot, and a second branch slot. The plurality of levers may include a moving lever which moves within the reference slot, the first branch slot, and a second branch slot. When the moving lever enters the first branch slot from the reference slot and moves by a predetermined distance and then moves in a reverse direction, the moving lever may enter the reference slot from the first branch slot. When the moving frame moves in a forward direction immediately after the moving lever enters the reference slot, the moving lever may enter the second branch slot from the reference slot.

The slot may include a reference slot, a first branch slot which branches from one end of the reference slot, and a second branch slot. The plurality of levers may include a moving lever which moves within the reference slot, the first branch slot, and a second branch slot, and may include a path change lever moving outside the slot. The path change member may include: a cam which rotates by being pushed by the movement of the path change lever; a spring which positions the cam at a basic position; and a block wall which blocks the rotation of the cam. When the rotation of the cam is blocked by the block wall while the moving frame moves in a forward direction, not only the path change lever may move along an outer surface of the cam, but also the moving lever may enter the first branch slot from the reference slot.

When the moving frame moves in the forward direction after the moving frame moves in a reverse direction and the moving lever re-enters the reference slot from the first branch slot, the moving lever may enter the second branch slot from the reference slot.

The path change member may include: a change member which is movable above or below the guide plate; and a solenoid which moves the change member above or below the guide plate. When the change member moves above the guide plate, any one of the plurality of levers moves along an outer surface of the change member, so that movement paths of the plurality of levers may be changed. When the change member moves below the guide plate, the movement paths of the plurality of levers may not be changed.

The slot may include a reference slot, a first branch slot which branches from one end of the reference slot, and a second branch slot. The reference slot may extend from one end thereof in a first direction. The first branch slot may include a first extension branch slot extending from the end of the reference slot in a first oblique direction and a second extension branch slot extending from an end of the first extension branch slot in a second direction opposite to the first direction. The second branch slot may extend from the end of the reference slot in the second direction.

The first extension branch slot of the first branch slot may be bent.

The plurality of levers may include a moving lever moving within the reference slot, the first branch slot, and the second branch slot. When the moving lever enters the first branch slot, the rotation frame may rotate at a predetermined angle in a rotation first direction.

The guide plate may include a guide which forms the slot. The slot may include a reference slot, a first branch slot which branches from one end of the reference slot, and a second branch slot. The guide may include a reference guide forming the reference slot, a first guide forming the first branch slot, and a second guide forming the second branch slot. On the basis of the guide plate, a height of the first guide may be less than a height of the second guide, and one of the plurality of levers may pass over the first guide.

The slot may include a reference slot, a first branch slot which branches from one end of the reference slot, and a second branch slot. The plurality of levers may include a moving lever which moves within the reference slot, the first branch slot, and a second branch slot. When the moving lever is located at an end of the first branch slot, the stapler may obliquely staple a bundle of sheets output from an image forming apparatus. When the moving lever is located within the second branch slot, the stapler may perform flat-stapling on a bundle of the sheets output from as mage forming apparatus.

The reference slot may extend from one end thereof in a first direction. The first branch slot may include a first extension branch slot extending from the end of the reference slot in a first oblique direction and a second extension branch slot extending from an end of the first extension branch slot in a second direction opposite to the first direction. The second branch slot may extend from the end of the reference slot in the second direction. When the moving lever is located at the second extension branch slot of the first branch slot, the stapler may obliquely staple a bundle of the sheets output from an image forming apparatus.

BRIEF DESCRIPTION OF THE DRAWINGS

The present disclosure will become more fully understood from the detailed description and the accompanying drawings, wherein.

DETAILED DESCRIPTION

Figure 1:
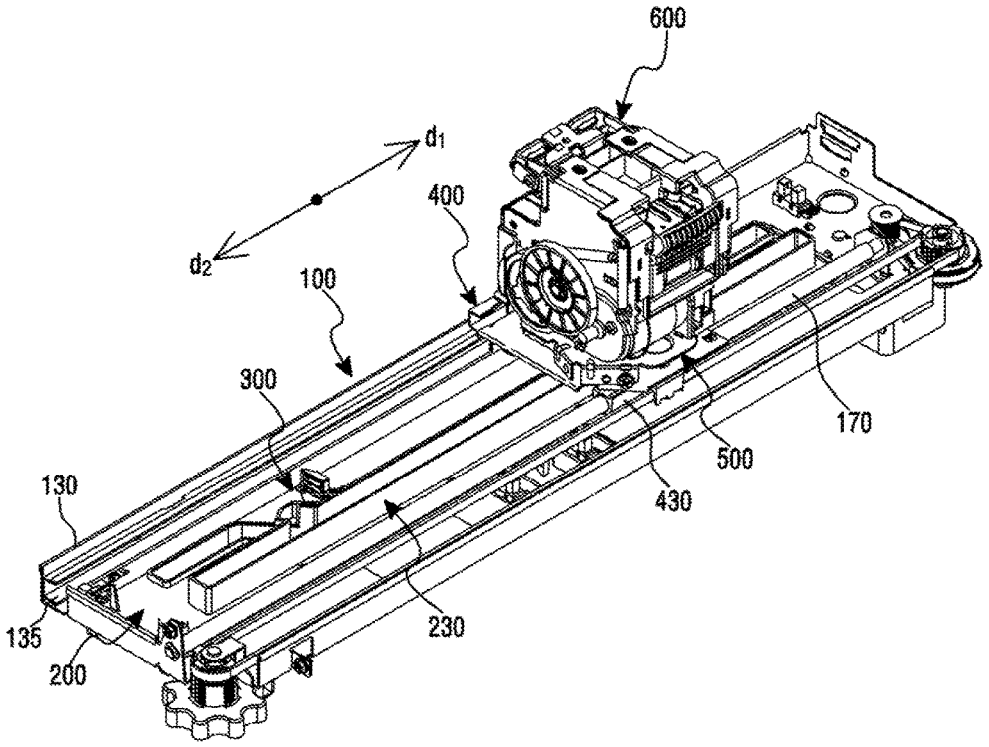
FIG. 1 is a perspective view of a stapler apparatus according to an embodiment of the present invention.

Hereafter, an exemplary embodiment of the present invention will be described in detail with reference to the accompanying drawings. It is noted that the same reference numerals are used to denote the same elements throughout the drawings. In the following description of the present invention, the detailed description of known functions and configurations incorporated herein is omitted when it may make the subject matter of the present invention unclear.

A stapler apparatus according to an embodiment of the present invention will be described with reference to the accompanying drawings. The stapler apparatus according to the embodiment of the present invention may be mounted within an image forming apparatus.

Figure 2:
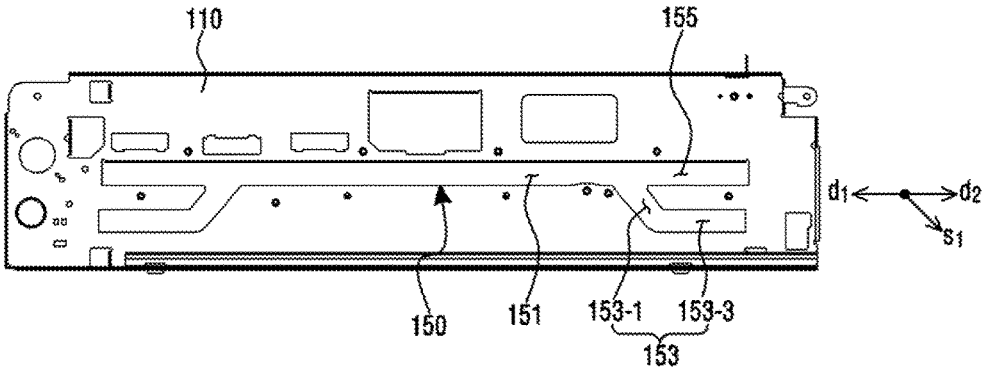
FIG. 2 is a plan view of a frame 100 shown in FIG. 1.
Figure 3:
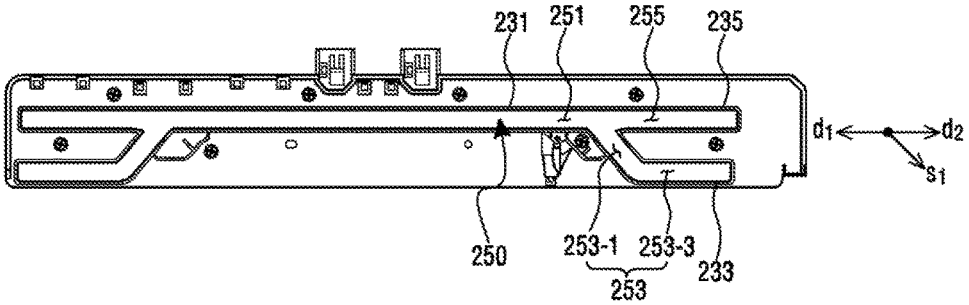
FIG. 3 is a plan view of a guide plate 200 shown in FIG. 1.
Figure 4:
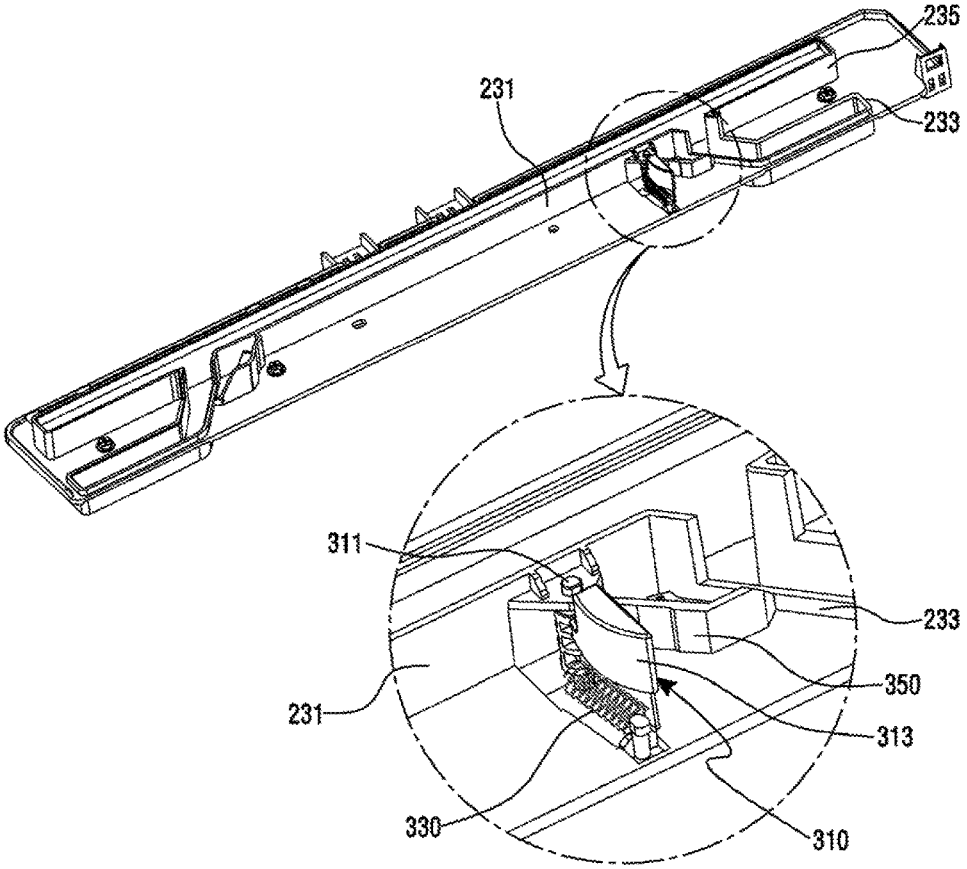
FIG. 4 shows a perspective view and a partial enlarged view of the guide plate 200 shown in FIG. 3.

FIG. 1 is a perspective views of a stapler apparatus according to an embodiment of the present invention. FIG. 2 is a plan view of a frame 100 shown in FIG. 1. FIG. 3 is a plan view of a guide plate 200 shown in FIG. 1. FIG. 4 shows a perspective view and a partial enlarged view of the guide plate 200 shown in FIG. 3.

Referring to FIG. 1, the frame 100 has a predetermined length in a first direction d1. Here, the first direction d1 may be designated as the longitudinal direction d1 of the frame 100 throughout this specification.

The frame 100 may include, as shown in FIG. 2, a bottom plate 110 having a predetermined thickness.

The bottom plate 110 has a slot 150. The slot 150 may include a reference slot 151 and a plurality of slots 153 and 155. The reference slot 151 is formed to extend in the first direction d1. The plurality of slots 153 and 155 branch from one end of the reference slot 151. Here, though not shown in the drawings, the plurality of slots 153 and 155 may be formed not only on one end of the reference slot 151 but also on the other end of the reference slot 151.

At least the two slots 153 and 155 may be included.

The plurality of slots 153 and 155 may include the first branch slot 153 and the second branch slot 155.

The first branch slot 153 includes a first extension branch slot 153-1 and a second extension branch slot 153-3. The first extension branch slot 153-1 extends from the end of the reference slot 151 in a first oblique direction s1. The second extension branch slot 153-3 extends from the end of the first extension branch slot 153-1 in a second direction d2 opposite to the first direction d1. Here, the first extension branch slot 153-1 may be formed straight. However, the shape of the first extension branch slot 153-1 is not limited to this. The first extension branch slot 153-1 may be formed to be bent.

The second branch slot 155 extends from the end of the reference slot 151 in the second direction d2. Comparing the end of the first branch slot 153 with the end of the second branch slot 155 on the basis of the end of the reference slot 151, the end of the first branch slot 153 and the end of the second branch slot 155 may be disposed at the same position. Otherwise, the end of the second branch slot 155 may be disposed longer than the first branch slot 153.

The first branch slot 153 and the second branch slot 155 may be formed not only on one end of the reference slot 151 but also on the other end of the reference slot 151 such that the first branch slot 153 and the second branch slot 155 formed on one end of the reference slot 151 may be symmetrical with the first branch slot 153 and the second branch slot 155 formed on the other end of the reference slot 151.

The frame 100 may include a side plate 130 shown in FIG. 1. The side plate 130 may be equipped with a rail 135. Rollers of a moving frame 400 may be mounted on the rail 135.

The frame 100 may include a support bar 170. The support bar 170 has a predetermined length and is disposed in the first direction d1 or in the second direction d2. The support bar 170 is fastened to a fastener 430 of the moving frame 400 and, together with the rail 135, allows the moving frame 400 to stably move.

The guide plate 200 is disposed on the frame 100. The guide plate 200 may be disposed on the bottom plate 110 of the frame 100.

The guide plate 200 includes a guide 230 disposed in the slot 150 of the frame 100. That is, the guide 230 may be disposed to be inserted into the slot 150 of the frame 100 shown in FIG. 2.

The guide 230 is disposed between the side plate 130 and the support bar 170 of the frame 100.

The guide 230 includes, as shown in FIG. 3, a slot 250 having a shape corresponding to the shape of the slot 150 of the frame 100 shown in FIG. 2. The size of the slot 250 is less than the size of the slot 150 of the frame 100 in order that the guide 230 is inserted into the slot 150 of the frame 100.

The slot 250 may include a reference slot 251 and a plurality of slots 253 and 255. The reference slot 251 is formed to extend in the first direction d1. The plurality of slots 253 and 255 branch from one end of the reference slot 251. Here, though not shown in the drawings, the plurality of slots 253 and 255 may be formed not only on one end of the reference slot 251 but also on the other end of the reference slobs 251.

The plurality of slots 253 and 255 may include at least two of the first branch slot 253 and the second branch slot 255.

The first branch slot 253 includes a first extension branch slot 253-1 and a second extension branch slot 253-3. The first extension branch slot 253-1 extends from the end of the reference slot 251 in the first oblique direction s1. The second extension branch slot 253-3 extends from the end of the first extension branch slot 253-1 in the second direction d2 opposite to the first direction d1. Here, the first extension branch slot 253-1 may be formed straight. However, the shape of the first extension branch slot 253-1 is not limited to this. The first extension branch slot 253-1 may be formed to be bent.

The second branch slot 255 extends from the end of the reference slot 251 in the second direction d2. Comparing the end of the first branch slot 253 with the end of the second branch slot 255 on the basis of the end of the reference slot 251, the end of the first branch slot 253 and the end of the second branch slot 255 may be disposed at the same position. Otherwise, the end of the second branch slot 255 may be disposed longer than the first branch slot 253.

The guide 230 includes a reference guide 231, a first guide 233, and a second guide 235. The reference guide 231 defines the reference slot 251. The first guide 233 defines the first branch slot 253. The second guide 235 defines the second branch slot 255. On the basis of the top surface of the guide plate 200, the height of the reference guide 231 may be the same as the height of the second guide 235 and may be different from the height of the first guide 233. That is, the height of the reference guide 231 may be greater than the height of the first guide 233. This intends to prevent the movement of a path change lever 515 shown in FIG. 5 from being disturbed. Therefore, the path change lever 515 shown in FIG. 5 passes over the first guide 233.

Figure 5:
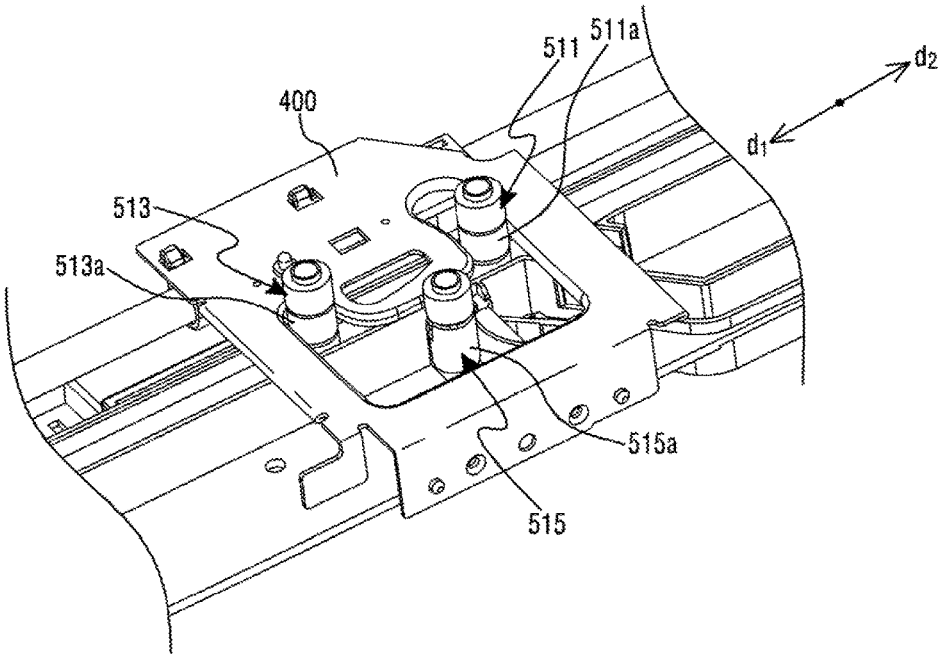
FIGS. 5 to 6 show a state immediately after a path change lever 515 comes in contact with a cam 310.

A path change member 300 changes directly the movement path of the path change lever 515 shown in FIG. 5, and thus, changes indirectly the movement path of a moving lever 511. The path change member 300 changes the movement path of the path change lever 515, and thus, causes the moving lever 511 to enter the first branch slot 253 from the end of the reference slot 251. Here, unless the path change member 300 changes the movement path of the path change lever 515, the moving lever 511 enters the second branch slot 255 from the end of the reference slot 251. This will be described in detail later with reference to the drawings.

The path change member 300 may include, as shown in FIG. 4, a cam 310, a spring 330, and a block wall 350.

The cam 310 includes a rotational axis 311. The rotational axis 341 is installed adjacent to the reference guide 231. The cam 310 is, as shown in FIG. 5, disposed on the movement path of the path change lever 515.

The cam 310 further includes a first outer surface 313 and a second outer surface (not shown). As shown in FIG. 5, the first outer surface 313 comes in contact with the path change lever 515. The movement path of the path change lever 515 may be changed along the first outer surface 313. The first outer surface 343 may be curved. The second outer surface (not shown) comes in contact with the block wall 350. When the second outer surface (not shown) comes in contact with the block wall 350, the cam 310 is not able to rotate any more along the rotational axis 311.

As long as a separate external force is not provided, the spring 330, together with the rotational axis 311, positions the cam 310 at a predetermined position (hereafter, referred to as a basic position).

Figure 7:
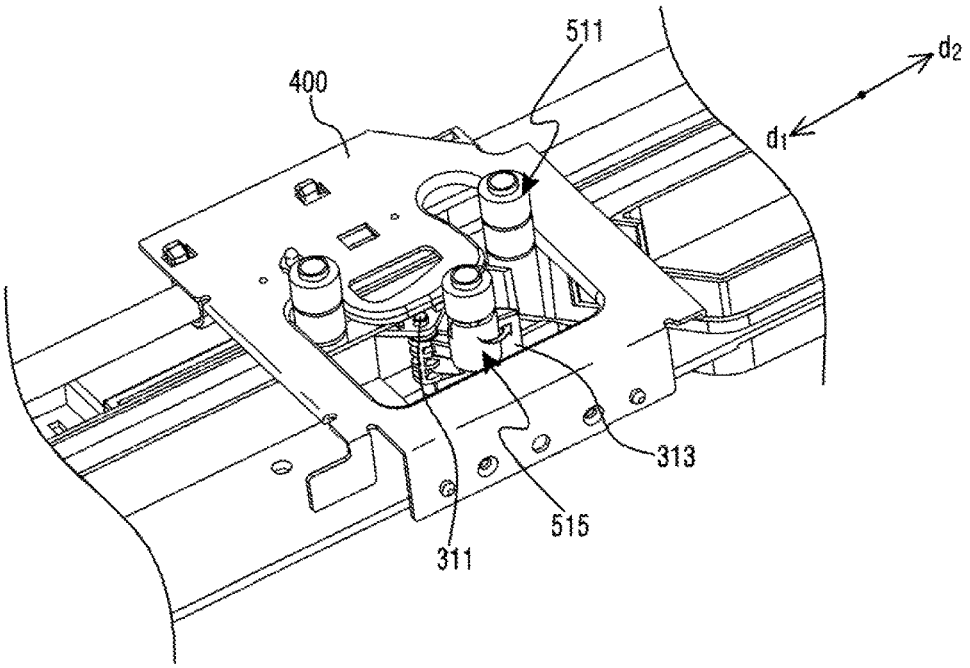
FIGS. 7 to 8 show a state where a path of the path change lever 515 is being changed by the cam 310.

The block wall 350 blocks, as shown in FIG. 7, the rotation of the cam 310 caused by the path change lever 515.

The block wall 350 may be disposed on the rotation path of the cam 310 and may be disposed between the reference guide 231 and the first guide 233.

The block wall 350 may be disposed below the movement path of the path change lever 515 shown in FIG. 5. Therefore, the path change lever 515 passes over the block wall 350 without directly contacting the block wall 350. On the basis of the top surface of the guide plate 200, the height of the block wall 350 may be the same as or greater than the height of the first guide 233.

The path change member 300 is not limited to the cam 310, the spring 330, and the block wall 350. For another example, the path change member 300 may include a change member (not shown) and a solenoid (not shown). The change member (not shown) may be installed at the position of the cam 310 and may move above or below the guide plate 200 by the solenoid (not shown). When the change member (not shown) has moved above the guide plate 200, the movement path of the path change lever 515 is changed. When the change member (not shown) has moved below the guide plate 200, the movement path of the path change lever 515 is not changed.

The moving frame 400 performs a reciprocating motion on the guide plate 200. The moving frame 400 performs a reciprocating motion in the first direction d1 or in the second direction d2.

Rollers which moves along the rail 135 mounted on the side plate 130 of the frame 100 may be mounted on the moving frame 400.

The fastener 430 which is fastened to the support bar 170 of the frame 100 may be mounted on the moving frame 400. The fastener 430 has a structure surrounding a portion of the support bar 170 and moves along the support bar 170 by the movement of the moving frame 400.

A rotation frame 500 is installed on the moving frame 400 and moves with the moving frame 400.

A stapler 600 is installed and fixed to the rotation frame 500. The stapler 600 is moved by the moving frame 400 and is rotated by the rotation frame 500. The stapler 600 staples at a predetermined position in accordance with an external control command.

Here, in FIGS. 1 to 12, the stapler 600 may be a punch which punches a bundle of sheets or a saddle stitcher which saddle-stitches a bundle of sheets.

A plurality of levers 511, 513, and 515 for rotating the stapler 600 at a predetermined angle are, as shown in FIG. 5, mounted on the rotation frame 500. Specifically, the plurality of levers 511, 513, and 515 are fixed and mounted on the bottom surface of the frame 500. For reference, FIG. 5 shows that the rotation frame 500 has been removed.

The plurality of levers 511, 513, and 515 include, as shown in FIG. 5, the moving lever 511, an axis lever 513, and the path change lever 515.

The moving lever 511 moves within the slot 250 of the guide 230. Specifically, the moving lever 511 may be inserted into the slot 250 and move within the reference slot 251, the first branch slot 253, and the second branch slot 255. In other words, the moving lever 511 may move within the reference slot 251, the first branch slot 253, and the second branch slot 255 in the first direction d1, in the second direction d2, and in the first oblique direction s1.

The moving lever 511 is guided by the reference guide 231, the first guide 233, and the second guide 235. A roller 511*a* may be mounted on the moving lever 511. The roller 511*a* reduces friction between the moving lever 511 and the reference guide 231, the first guide 233, and the second guide 235. Accordingly, the moving lever 511 is able to move more smoothly.

The axis lever 513 is disposed apart from the moving lever 511 at a predetermined interval. The axis lever 513, together with the moving lever 511, moves within the slot 250 of the guide 230. Here, unlike the moving lever 511, the axis lever 513 cannot move to the first branch slot 253 and can move within the reference slot 251 and the second branch slot 255. That is, the axis lever 513 can move within the reference slot 251 and the second branch slot 255 in the first direction d1 and in the second direction d2.

The axis lever 513 is guided by the reference guide 231 and the second guide 235. A roller 515*a* may be mounted on the axis lever 513.

Figure 8:
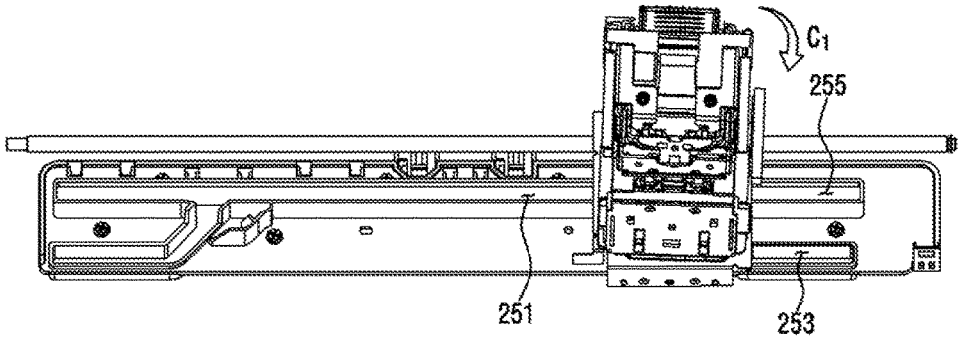
Figure 10:
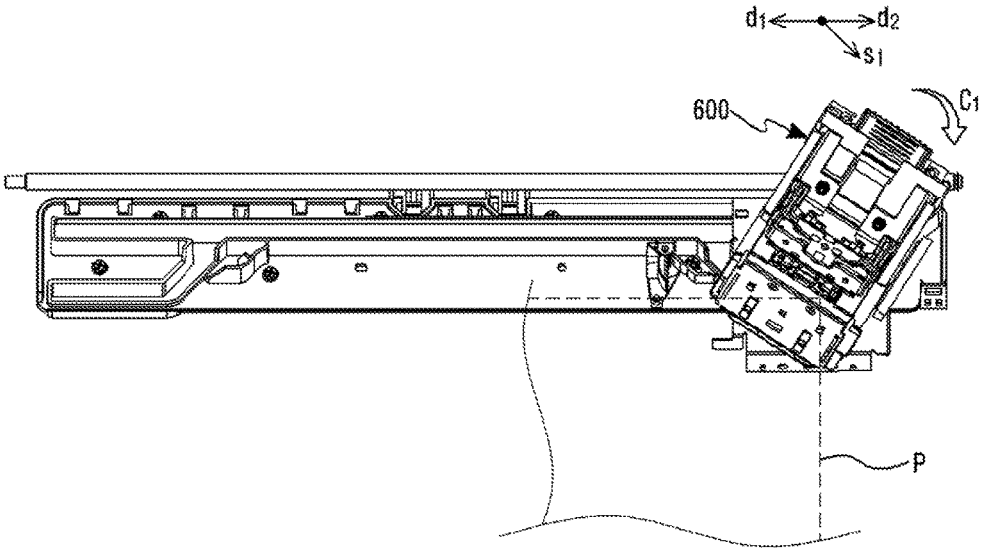

The axis lever 513 functions as a rotational axis of the rotation frame 500. Specifically, when the moving lever 511 enters the first branch slot 253, the rotation frame 500 rotates, as shown in FIGS. 8 and 10, clockwise (a first rotation direction, C1) at a predetermined angle. Here, the rotation frame 500 rotates about the axis lever 513. Here, the moving frame 400 does not rotate.

The moving lever 511 may function as the axis lever, and the axis lever 513 may function as the moving lever. This case occurs when the moving frame 400 moves to the other end of the reference slot 251. Therefore, it should be understood that the moving lever 511 and the axis lever 513 are relative rather than absolute.

The path change lever 515 is disposed apart from the moving lever 511 and the axis lever 513 at a predetermined interval and is disposed on the guide plate 200.

Unlike the moving lever 511 and the axis lever 513, the path change lever 515 is not disposed within the slot 250 of the guide 230. The path change lever 515 is able to move above the first branch slot 253 and does not move within the first branch slot 253.

The path change lever 515 moves in parallel with the axis lever 513. That is, the path change lever 515 may move in the first direction d1 and in the second direction d2.

The path change member 300 is disposed on the movement path of the path change lever 515. The movement path of the path change lever 515 is changed by the contact of the path change lever 515 with the path change member 300. That is, the path change lever 515 moves in the first oblique direction s1 by the path change member 300. As the path change lever 515 moves in the upper oblique direction s1, the moving lever 511 enters the first branch slot 253 from the reference slot 251.

If the path change lever 515 does not contact the path change member 300, the moving lever 511 does not enter the first branch slot 253 and enters the second branch slot 255.

Hereinafter, a method in which the moving lever 511 enters the first branch slot 253 from the reference slot 251 will be described in detail with reference to FIGS. 5 to 10.

Figure 6:
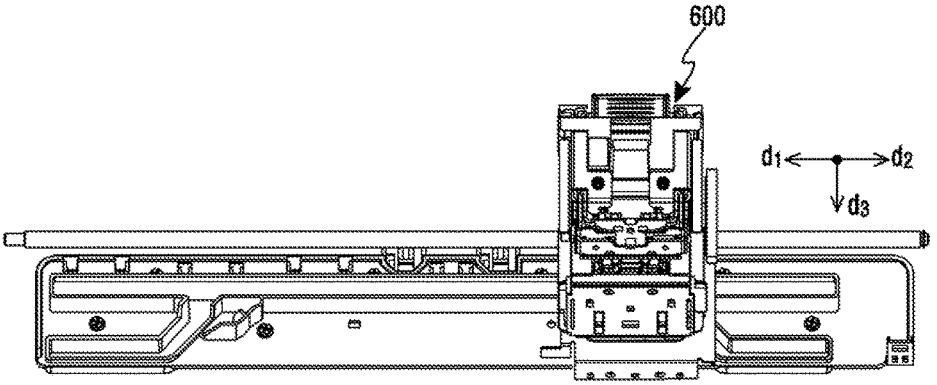

FIGS. 5 to 6 show a state immediately after the path change lever 515 comes in contact with the cam 310.

Referring to FIGS. 5 to 6, when the moving frame 400 moves in the second direction d2, the moving lever 511, the axis lever 513, and the path change lever 515 which have been mounted on the rotation frame 500 move together in the second direction d2.

When the cam 310 fixed to the basic position by the rotational axis 311 and the spring 330 contacts the path change lever 515 (namely, when the path change lever 515 comes in contact with the first outer surface 313 of the cam 310) while the path change lever 515 moves in the second direction d2, the path change lever 515 starts to push cam 310. Here, stapler 600 is, as shown in FIG. 6, directed in a third direction d3 perpendicular to the second direction d2 because the rotation frame 500 is not rotating.

FIGS. 7 to 8 show a state where the path of the path change lever 515 is being changed by the cam 310.

Referring to FIGS. 7 to 8, when the moving frame 400 moves continuously in the second direction d2, the path change lever 515 moves in the second direction d2 while pushing the cam 310. Here, the cam 310 rotates along the rotational axis 311 before the cam 310 contacts the block wall 350 shown in FIG. 4 by being pushed by the path change lever 515. When the cam 310 cannot rotate any more by the block wall 350, the path change lever 515 moves along the first outer surface 313 in a state of contacting the first outer surface 313 of the cam 310. At the moment when the path change lever 515 moves along the first outer surface 313, the movement path of the path change lever 515 is changed and the rotation frame 500 rotates clockwise (C1) slightly about the axis lever 513. Due to the rotation of the rotation frame 500, the moving lever 511 enters the first branch slot 253 from the reference slot 251, and, as shown in FIG. 8, the stapler 600 rotates clockwise (C1) slightly in conjunction with the rotation frame 500.

Figure 9:
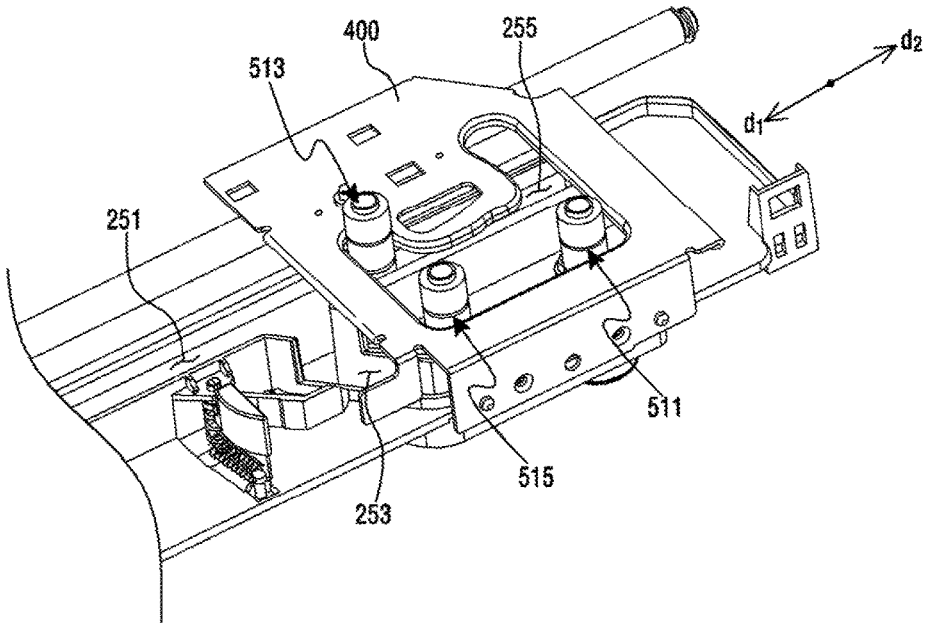
FIGS. 9 to 10 show that a moving lever 511 enters continuously a first branch slot 253 from a reference slot 251 by a rotation of a rotation frame 500 and then enters the end of the first branch slot 253.

FIGS. 9 to 10 show that the moving lever 511 enters continuously the first branch slot 253 from the reference slot 251 by the rotation of the rotation frame 500 and then enters the end of the first branch slot 253.

Referring to FIGS. 9 to 10, when the moving lever 511 enters the first branch slot 253, the moving lever 511 moves along the first branch slot 253 in the first oblique direction 1, and then moves in the second direction d2 by the movement of the moving frame 400 in the second direction d2. During this process, the stapler 600 further rotates clockwise (C1), and then becomes the state of FIG. 10. When the stapler 600 is in the state of FIG. 10, it is possible to obliquely staple a corner of a bundle of sheets P output from the image forming apparatus.

In the state shown in FIG. 10, it can be designated as an "automatic staple mode" because a bundle of sheets P output from the image forming apparatus are stapled.

A method in which the moving lever 511 enters the second branch slot 255 will be described in detail with reference to FIGS. 11 to 12.

Figure 11:
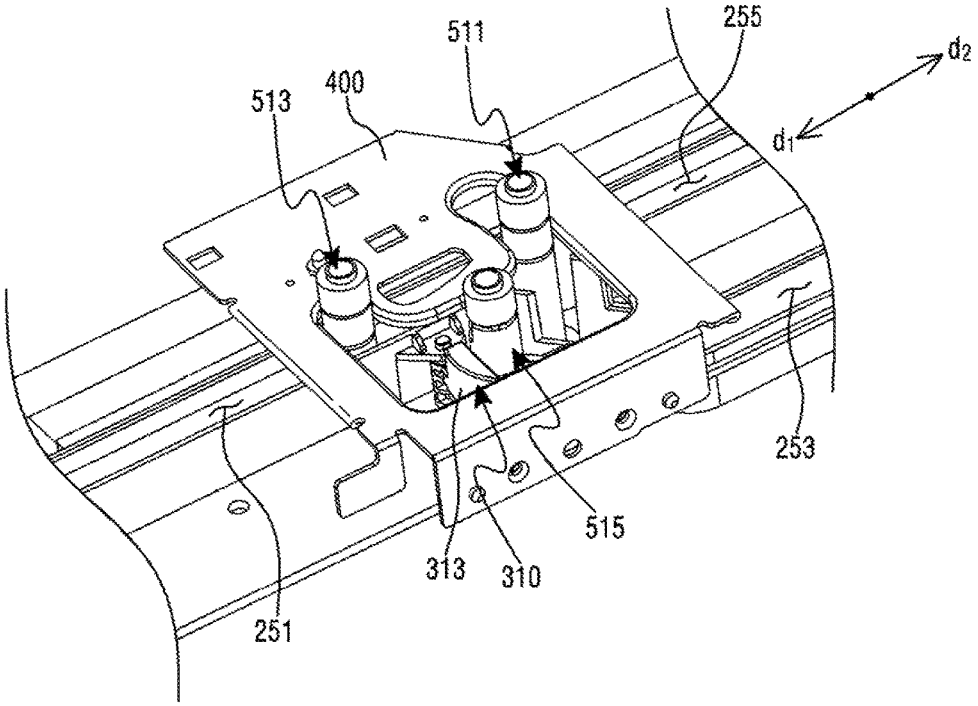
FIGS. 11 to 12 show a state immediately after the moving lever 511 escapes from the first branch slot 253 and then enters the reference slot 251.
Figure 12:
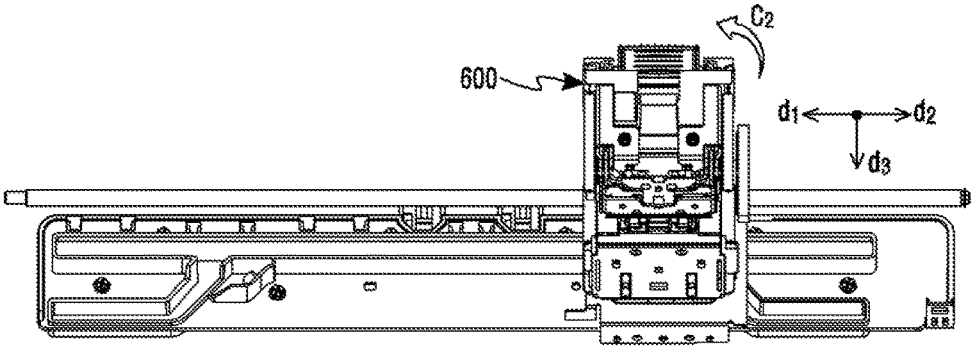

FIGS. 11 to 12 show a state immediately after the moving lever 511 escapes from the first branch slot 253 and then enters the reference slot 251.

In order that the moving lever 511 enters the second branch slot 255, the processes of FIGS. 5 and 7 are sequentially performed. However, after that, the process may not reach the state shown in FIG. 9.

For example, as described in FIG. 7, after the moving lever 511 enters the first branch slot 253, the moving lever 511 moves to the first branch slot 253 by a predetermined distance due to the change of the movement path of the path change lever 515. Here, the predetermined distance corresponds to a distance by which the path change lever 515 passes by the cam 310 and then the cam 310 is able to move to the basic position by the spring 330.

Immediately after the moving lever 511 moves within the first branch slot 253 by a predetermined distance, the moving frame 400 retreats in the first direction d1 opposite to the second direction d2. Due to the retreat of the moving frame 400, the moving lever 511 returns to the reference slot 251 from the first branch slot 253 and then becomes the state of FIGS. 11 to 12. In the state of FIGS. 11 to 12, the moving lever 511 is not disposed on the first outer surface 313 of the cam 310 but on the second outer surface (not shown). The stapler 600 rotates counterclockwise (a second rotation direction, C2) and is directed in the third direction d3.

In the state of FIGS. 11 to 12, when the moving frame 400 moves in the second direction d2, the movement path of the path change lever 515 is not changed and the path change lever 515 moves in the second direction d2, i.e., the movement direction of the moving frame 400 because the path change lever 515 is not affected by the cam 310. Also, the moving lever 511 enters the second branch slot 255 from the reference slot 251. Here, when the moving lever 511 enters the second branch slot 255 from the reference slot 251 and then stops, the stapler 600 can staple at the moment when the moving lever 511 stops. The moving lever 511 may stops at least twice. In the state where the stapler 600 is, as shown in FIG. 12, directed in the third direction d3, a bundle of sheets can be flat-stapled at least twice by the stapler 600. As such, the stapler apparatus according to the embodiment of the present invention is able not only to obliquely staple a corner of a bundle of sheets, but also to perform the flat-stapling.

While the embodiment of the present invention has been described with reference to the accompanying drawings, these are just examples and do not limit the present invention. Further, the present invention may be changed and modified in various ways, without departing from the essential features of the present invention, by those skilled in the art. For example, the components described in detail in the embodiments of the present invention may be modified. Further, differences due to the modification and application should be construed as being included in the scope and spirit of the present invention, which is described in the accompanying claims.

What is claimed is:

1. A stapler apparatus comprising:

a guide plate in which a slot having a branch structure has been formed;

a moving frame which is reciprocatively movable on the guide plate;

a rotation frame which is rotatable on the moving frame and comprises a plurality of levers mounted thereon, wherein the plurality of levers move along the inside and outside of the slot or change paths;

a path change member which changes a movement path of any one of the plurality of levers; and a stapler which is mounted on the rotation frame and is in conjunction with the rotation frame;

wherein the slot comprises a reference slot and a plurality of branch slots which branch from one end of the reference slot;

wherein the plurality of levers comprise a moving lever moving within the slot and comprise a path change lever moving outside the slot;

wherein the path change member changes a movement path of the path change lever and causes the moving lever to enter, from the reference slot, into any one of the plurality of branch slots which extends in a direction different from an extension direction of the reference slot; and wherein, when the path change member does not change the movement path of the path change lever, the moving lever enters, from the reference slot, into one of the plurality of branch slots which extends in a direction the same as an extension direction of the reference slot.

2. The stapler apparatus of claim 1, wherein the plurality of branch slots comprises a first branch slot and a second branch slot;

wherein the reference slot extends from one end thereof in a first direction;

wherein the first branch slot comprises a first extension branch slot extending from the end of the reference slot in a first oblique direction and a second extension branch slot extending from an end of the first extension branch slot in a second direction opposite to the first direction; and wherein the second branch slot extends from the end of the reference slot in the second direction.

3. The stapler apparatus of claim 2, wherein the first extension branch slot of the first branch slot is bent.

4. The stapler apparatus of claim 2, wherein, when the moving lever enters the first branch slot, the rotation frame rotates at a predetermined angle in a rotation first direction.

5. The stapler apparatus of claim 1, wherein the guide plate comprises a guide which forms the slot;

wherein the plurality of branch slots comprises a first branch slot and a second branch slot;

wherein the guide comprises a reference guide forming the reference slot, a first guide forming the first branch slot, and a second guide forming the second branch slot; and wherein, on the basis of the guide plate, a height of the first guide is less than a height of the second guide, and one of the plurality of levers passes over the first guide.

6. The stapler apparatus of claim 1, wherein the plurality of branch slots comprises a first branch slot and a second branch slot;

wherein, when the moving lever is located at an end of the first branch slot, the stapler obliquely staples a bundle of sheets output from an image forming apparatus; and wherein, when the moving lever is located within the second branch slot, the stapler performs flat-stapling on a bundle of the sheets output from an image forming apparatus.

7. The stapler apparatus of claim 6, wherein the reference slot extends from one end thereof in a first direction;

wherein the first branch slot comprises a first extension branch slot extending from the end of the reference slot in a first oblique direction and a second extension branch slot extending from an end of the first extension branch slot in a second direction opposite to the first direction;

wherein the second branch slot extends from the end of the reference slot in the second direction; and wherein, when the moving lever is located at the second extension branch slot of the first branch slot, the stapler obliquely staples a bundle of the sheets output from an image forming apparatus.

8. The stapler apparatus of claim 7, wherein the first extension branch slot of the first branch slot is bent.

9. A stapler apparatus comprising:

a guide plate in which a slot having a branch structure has been formed;

a moving frame which is reciprocatively movable on the guide plate;

a rotation frame which is rotatable on the moving frame and comprises a plurality of levers mounted thereon, wherein the plurality of levers move along the inside and outside of the slot or change paths;

a path change member which changes a movement path of any one of the plurality of levers; and a stapler which is mounted on the rotation frame and is in conjunction with the rotation frame;

wherein the slot comprises a reference slot, a first branch slot which branches from one end of the reference slot, and a second branch slot;

wherein the plurality of levers comprise a moving lever which moves within the reference slot, the first branch slot, and a second branch slot;

wherein, when the moving lever enters the first branch slot from the reference slot and moves by a predetermined distance and then moves in a reverse direction, the moving lever enters the reference slot from the first branch slot; and wherein, when the moving frame moves in a forward direction immediately after the moving lever enters the reference slot, the moving lever enters the second branch slot from the reference slot.

10. A stapler apparatus comprising:

a guide plate in which a slot having a branch structure has been formed;

a moving frame which is reciprocatively movable on the guide plate;

a rotation frame which is rotatable on the moving frame and comprises a plurality of levers mounted thereon, wherein the plurality of levers move along the inside and outside of the slot or change paths;

a path change member which changes a movement path of any one of the plurality of levers; and a stapler which is mounted on the rotation frame and is in conjunction with the rotation frame;

wherein the slot comprises a reference slot, a first branch slot which branches from one end of the reference slot, and a second branch slot;

wherein the plurality of levers comprise a moving lever which moves within the reference slot, the first branch slot, and a second branch slot, and comprise a path change lever moving outside the slot;

wherein the path change member comprises:

a cam which rotates by being pushed by the movement of the path change lever;

a spring which positions the cam at a basic position; and a block wall which blocks the rotation of the cam; and wherein, when the rotation of the cam is blocked by the block wall while the moving frame moves in a forward direction, not only the path change lever moves along an outer surface of the cam, but also the moving lever enters the first branch slot from the reference slot.

11. The stapler apparatus of claim 10, wherein, when the moving frame moves in the forward direction after the moving frame moves in a reverse direction and the moving lever re-enters the reference slot from the first branch slot, the moving lever enters the second branch slot from the reference slot.

* * * * *